US006851343B2

(12) United States Patent
Sasaki

(10) Patent No.: US 6,851,343 B2
(45) Date of Patent: Feb. 8, 2005

(54) SCREWDRIVER

(75) Inventor: Katsuhiko Sasaki, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 10/379,974

(22) Filed: Mar. 5, 2003

(65) Prior Publication Data

US 2003/0233917 A1 Dec. 25, 2003

(30) Foreign Application Priority Data

Mar. 5, 2002 (JP) ..... 2002-059104
May 13, 2002 (JP) ..... 2002-137443

(51) Int. Cl.[7] ..... B25B 23/157
(52) U.S. Cl. ..... 81/475; 81/473; 173/176; 173/15
(58) Field of Search ..... 81/429, 467, 473–476, 81/58, 58.3; 173/176, 178, 211, 15; 192/54.1, 56.1, 56

(56) References Cited

U.S. PATENT DOCUMENTS 3,834,252 A * 9/1974 Abell et al. ..... 81/475
4,655,103 A 4/1987 Schreiber et al. ..... 81/474
5,134,909 A * 8/1992 Sasaki ..... 81/473
5,138,916 A * 8/1992 Sato et al. ..... 81/474
5,209,308 A * 5/1993 Sasaki ..... 173/178
5,271,471 A * 12/1993 Sasaki ..... 173/178
5,568,849 A 10/1996 Sasaki et al. ..... 192/34
5,881,613 A * 3/1999 Han ..... 81/429
6,176,162 B1 * 1/2001 Ludwig et al. ..... 81/473

FOREIGN PATENT DOCUMENTS

DE 4310624 A1 * 10/1993 ..... B25B/21/00
EP 476999 A1 * 3/1992 ..... B25B/23/14
JP 06285769 A * 10/1994 ..... B25B/21/00
JP 2000237971 A * 9/2000 ..... B25B/23/157

* cited by examiner

*Primary Examiner*—David B. Thomas
(74) *Attorney, Agent, or Firm*—Lahive & Cockfield, LLP; Anthony A. Laurentano, Esq.

(57) ABSTRACT

A representative screwdriver may comprise a motor, a body, a first spindle, a first clutch member, a tool bit, a second spindle, a second clutch member, a clutch engagement preventing member. The representative screwdriver may be selectively operated in one of a first power transmission mode and a second power transmission mode. In the first power transmission mode, the first clutch member and the second clutch member are disengaged when the reaction torque applied from the work-piece onto the tool bit exceeds a predetermined torque. In the second power transmission mode, the first clutch member and the second clutch member are disengaged when the tool bit moves a predetermined distance away from the body toward the work-piece during the screw-tightening operation. According to the representative screwdriver, the engagement and disengagement of the clutch members during the screw-tightening operation can be assuredly performed in both the operation modes.

21 Claims, 8 Drawing Sheets

SCREWDRIVER

BACKGROUND OF THE INVENTION

1. Field of the Invention

The invention relates to a screwdriver that includes a silent clutch.

2. Description of the Related Art

An electric screwdriver is disclosed in unexamined Japanese laid-open patent publication No. 61-219581. The known screwdriver includes a silent clutch mechanism to connect a tool bit to a motor for transmitting the rotating torque of the motor to the tool bit. The silent clutch includes clutch members with clutch teeth that can be engaged with each other to transmit the motor torque to the tool bit. By utilizing the silent clutch mechanism, when the screw is tightened to a predetermined depth with respect to the work-piece, the clutch members can be promptly disengaged to stop transmission of the rotating torque of the driving motor. As a result, noise and vibration during screw-tightening operation can be avoided.

According to the known screwdriver, it is necessary to assuredly perform the disengagement of the clutch members when the screw-tightening operation is completed in order to prevent the clutch teeth of the clutch members from contacting with each other during the operation. Thus, further improvement of technique is desired to promptly and assuredly disengage the clutch members to cut the transmission of the motor torque in various operating conditions of the screwdriver.

SUMMARY OF THE INVENTION

It is, accordingly, an object of the present invention to provide an electric screwdriver having a silent clutch that can assuredly perform the engagement and disengagement of the clutch members during the screw-tightening operation.

According to one aspect of the present teachings, a representative screwdriver may include a motor, a body, a first spindle, a first clutch member, a tool bit, a second spindle, a second clutch member, a clutch engagement preventing member. The body houses the motor. The first spindle rotates and moves relative to the body. The first clutch member is disposed on one end portion of the first spindle. The first clutch member rotates together with the first spindle and is allowed to move relative to the first spindle in the axial direction of the first spindle. The tool bit is connected to the other end portion of the first spindle to perform a screw tightening operation. The second spindle is connected to the motor and receives the rotating torque of the motor. The second clutch member rotates together with the second spindle. The second clutch member is allowed to move relative to the second spindle in the axial direction of the second spindle. Further, the second clutch member is engaged with the first clutch member when the first spindle moves toward the body to transmit the rotating torque of the motor to the tool bit. The clutch engagement preventing member urges the first clutch member and the second clutch member away from each other.

The representative screwdriver may be selectively operated in one of a first power transmission mode and a second power transmission mode. When the screwdriver is operated within the first power transmission mode, the first clutch member and the second clutch member engage with each other in order to transmit the rotating torque of the motor to the tool bit. On the other hand, the first and second clutch members are disengaged from each other when the reaction torque applied from the work-piece onto the tool bit exceeds a predetermined torque.

Further, when the screwdriver is operated within the second power transmission mode, the first clutch member and the second clutch member engage with each other to transmit the rotating torque of the motor to the tool bit. On the other hand, the clutch members are disengaged from each other when the tool bit moves a predetermined distance away from the body toward the work-piece during the screw-tightening operation.

According to the representative screwdriver, the engagement and disengagement of the clutch members during the screw-tightening operation can be assuredly performed in both the operation mode of tightening a screw while controlling the screw-tightening torque and the operation mode of completing the tightening operation according to the screw-tightening depth.

Other objects, features and advantages of the present invention will be readily understood after reading the following detailed description together with the accompanying drawings and the claims.

BRIEF DESCRIPTION OF THE DRAWINGS

In FIG. 2, the screw-tightening operation has not been started yet.

In FIG. 5, the torque of the motor is transmitted to the tool bit so that the screw-tightening operation is proceeding.

In FIG. 6, the tightening torque increases excessively and thus the second clutch cam starts to move backward.

In FIG. 7, the second clutch cam moves away from the first clutch cam by the biasing force of the clutch engagement preventing spring and the stopper protrudes outward.

In FIG. 9, the second clutch cam is prevented from moving backward.

In FIG. 11, the torque of the motor is transmitted to the tool bit so that the screw-tightening operation is proceeding.

DETAILED DESCRIPTION OF THE REPRESENTATIVE EMBODIMENT

Figure 1:
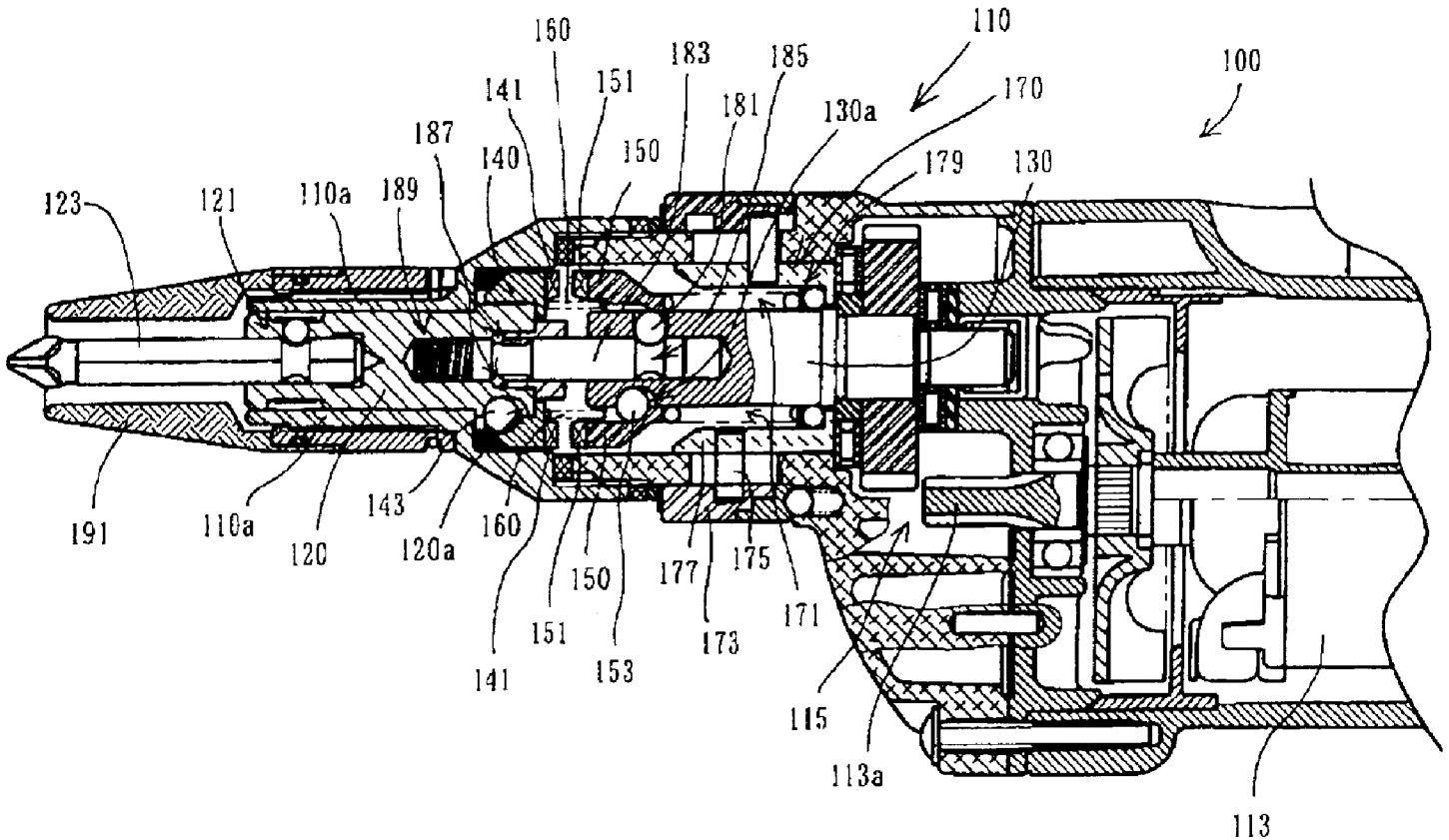
FIG. 1 shows essential part of an electric screwdriver according to the representative embodiment of the invention.

According to the present teachings, a representative electric screwdriver may include a body in which a motor is housed, a first spindle, a second spindle, a first clutch member, a second clutch member and a clutch engagement preventing member.

The first spindle can be rotated and moved relative to the body. The body may typically comprise a motor housing and/or a gear housing. The first clutch member is disposed on one end portion of the first spindle. The first clutch member rotates together with the first spindle and is allowed to move relative to the first spindle in the axial direction of the first spindle. The tool bit is connected to the other end portion of the first spindle to perform a screw tightening operation. The second spindle is connected to the motor and receives the rotating torque of the motor. Preferably, the second spindle may be connected to the motor via a speed reducing mechanism utilizing planetary gears that go around a circumference of a sun gear.

The second clutch member is allowed to move relative to the second spindle in the axial direction of the second spindle. Further, the second clutch member is engaged with the first clutch member when the first spindle moves towards the body to transmit the rotating torque of the motor to the tool bit. The first spindle moves toward the body together with the tool bit, typically when the first spindle receives the reaction force against the pressing load that the user of the screwdriver applies when pressing the body against the work-piece during the screw-tightening operation. An AC motor, a DC brushless motor or other various motors may be utilized as a motor for transmitting a rotating torque to the tool bit.

The clutch engagement preventing member urges (biases) the first clutch member and the second clutch member away from each other. Typically, the clutch engagement preventing member may include a biasing member such like a biasing spring disposed between the first clutch member and the second clutch member. Preferably, in order to reliably ensure the function as a silent clutch, the biasing force of the clutch engagement preventing member may be suitably selected so as to promptly and reliably disengage the first clutch member and the second clutch member upon completion of the screw-tightening operation.

According to the present teachings, the screwdriver can be selectively operated in one of two different power transmission modes. According to the first power transmission mode, the first clutch member and the second clutch member engage with each other and transmit the driving torque of the motor to the tool bit. Further, when the reaction torque applied from the work-piece onto the tool bit exceeds a predetermined torque, the clutch members are disengaged from each other.

According to the second power transmission mode, the first clutch member and the second clutch member engage with each other and transmit the rotating torque of the motor to the tool bit. Further, when the tool bit moves a predetermined distance away from the body toward the work-piece in screw-tightening operation, the clutch members are disengaged from each other in response to the depth of tightening the screw with the tool bit. Thus, the first and the second power transmission modes can be selectively provided such that the clutch members can be assuredly disengaged both in two different disengaging patterns.

In the first disengaging mode, when the reaction torque from the work-piece (or the tightening torque of the screw) exceeds a predetermined torque, the first and the second clutch members are disengaged from each other. Typically, the first clutch member on the tool bit is prevented from rotating by tightening the screw on the work-piece, while the second clutch member further transmits the rotating torque of the motor. A silent clutch is provided to promptly move the clutch members away from each other upon disengagement between the clutch members in order to prevent noise and vibration caused by the connection of the rotating clutch members.

In the second disengaging mode, when the tool bit moves a predetermined distance away from the body toward the work-piece during the screw-tightening operation, the clutch members are disengaged from each other. Typically, when the tool bit moves a predetermined distance away from the body toward the work-piece, the first spindle and the first clutch member also move a predetermined distance away from the body. Thus, the first clutch member moves away from the second spindle, so that the clutch members are disengaged from each other.

According to the present teachings, a highly practical electric screwdriver can be provided which can be used in both the operation mode of tightening a screw by controlling the screw-tightening torque and the operation mode of completing the tightening operation in response to the screw-tightening depth.

Preferably, the screwdriver may include a position control mechanism for the second clutch member. Preferably, the position control mechanism may include a first position control mechanism and a second position control mechanism for the second clutch member in the first power transmission mode. The first position control mechanism may control the second clutch member so as to hold the second clutch member in a torque transmission permitted position near to the first clutch member when the reaction torque applied from the work-piece onto the tool bit is within a predetermined range. With respect to the state that "the reaction torque is within a predetermined range", it is the typical case that the screw-tightening operation is not yet completed and the reaction torque applied to the tool bit is not yet increased excessively.

Preferably, the second position control mechanism may prevent the second clutch member from moving (returning) to the torque transmission permitted position when the reaction torque exceeds the predetermined range by holding the second clutch member in a torque transmission prevented position. The torque transmission prevented position is distant from the first clutch member in comparison with the torque transmission permitted position. With respect to the state that "the reaction torque exceeds the predetermined range", it is the typical case that the reaction torque applied to the tool bit increases excessively by further applying a tightening torque onto the screw that has already been tightened in the screw-tightening operation and cannot be further tightened.

In other words, when the screw-tightening operation is substantially completed and the reaction torque from the work-piece to the tool bit exceeds the predetermined range (when the reaction torque increases excessively), the second clutch member is held in the torque transmission prevented position and is prevented from returning to the torque transmission permitted position. Thus, the second clutch member in the torque transmission prevented position can be prevented from unintentionally engaging with the first clutch member. As a result, any noise and vibration can be prevented caused by the unintentional engagement of both the clutch members.

Preferably, the screwdriver may be constructed such that the second clutch member can be promptly moved from the torque transmission permitted position to the torque transmission prevented position based upon the biasing force of the clutch engagement preventing member. The first position control mechanism and the second position control mechanism may be provided separately as independent elements or integrally.

By constructing the screwdriver as described above, when the screw-tightening operation is substantially completed and the reaction torque from the work-piece onto the tool bit increases excessively, the second clutch member, which is disengaged from the first clutch member and held in the torque transmission prevented position, is prevented from moving to the torque transmission permitted position. Thus, in the screwdriver in the first power transmission mode for performing screw-tightening operation, clutch disengagement can be promptly and reliably performed in response to the screw-tightening torque. Further, the disengaged clutch members can be prevented from being unintentionally engaged so that noise and vibration can be effectively prevented.

Preferably, the screwdriver may include a second-clutch backward movement preventing member for preventing the second clutch member in the second power transmission mode from moving backward away from the first clutch member in the axial direction of the second spindle. The second-clutch backward movement preventing member keeps the position of the second clutch member unchanged with respect to the first clutch member.

Further, the second-clutch backward movement preventing member may be arranged and configured to serve as the first position control member in the first power transmission mode. As the result of such construction, some components can be utilized in common in the both power transmission modes and the structure of the screwdriver can be simplified. For example, a spring may be provided between the second clutch member and the body so that the second clutch member can be urged toward the first clutch member by the biasing force of the spring.

Preferably, in the second power transmission mode, the screwdriver may further include a body position defining member to prevent the body from approaching within a predetermined distance of the work-piece. The screw-tightening operation in the second power transmission mode may be performed in the state in which the body position defining member prevents the body from approaching the work-piece within the predetermined distance of the work-piece. As the body position defining member, a locator may be utilized. In such case, when the body is pressed toward the work-piece in the screw-tightening operation, the locator disposed between the work-piece and the body can prevent the body from approaching within the predetermined distance of the work-piece. As a result, the position of the body in relation to the work-piece (in other words, distance between the body and the work-piece) can be precisely defined by the locator.

Thus, by performing the screw-tightening operation in the state in which the body is prevented from approaching within the predetermined distance of the work-piece, the first spindle moves relative to the body toward the work-piece together with the first clutch member. As a result, the first clutch member is disengaged from the second clutch member. Thus, the screw-tightening operation can be completed in response to the screw-tightening depth.

Each of the additional features and method steps disclosed above and below may be utilized separately or in conjunction with other features and method steps to provide improved screwdrivers and method for using such screw driver and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

FIG. 1 shows a representative electric screwdriver 100 according to one aspect of the present technical teachings. In FIG. 1, however, only an essential part of the body 110 of the screwdriver 100 such as a motor housing and a gear housing is shown. To the contrary, a grip portion that is connected to the body 110 is not particularly shown.

The screwdriver 100 includes a body 110, a first spindle 120, a second spindle 130, a first clutch cam 140, a second clutch cam 150, a clutch engagement preventing spring 160 and a position control mechanism 170 for the second clutch cam.

The first clutch cam 140 is a feature that corresponds to a "first clutch member" according to the present invention, the second clutch cam 150 to a "second clutch member", the clutch engagement preventing spring 160 to "clutch engagement preventing member", and the position control mechanism 170 for the second clutch cam to "position control mechanism for the second clutch member", respectively.

A motor 113 is disposed within the motor housing 110 of the screwdriver 100. An output shaft 113*a* of the motor 113 is connected to the second spindle 130 via a speed reducing mechanism 115. The speed reducing mechanism 115 may include a known reduction gear.

First spindle 120 is rotatably mounted in the tip end portion of the motor housing 110 (in the left end portion thereof as shown in FIG. 1) and disposed coaxially with the second spindle 130. The first spindle 120 is supported in a sleeve 110*a* of the motor housing 110 and can be moved relative to the second spindle 130 in the axial direction of the first spindle 120. A tool bit mounting chuck 121 is mounted to the front end of the first spindle 120. And the first clutch cam 140 is mounted on the other end (the right end in FIG. 1) of the first spindle 120. A tool bit 123 is torque responsive mode coupled to the tool bit mounting chuck 121.

A locator 191 may be detachably mounted on the sleeve 110*a* and covers the tool bit 123 up to near the tip end. The locator 191 has a sleeve-shape and keeps distance between the body 110 and the work-piece 125 in order to prevent the body 110 from approaching too near to the work-piece 125, while the tool bit 123 can move toward the work-piece 125. In this representative embodiment, the locator 191 is to be removed from the sleeve 110*a* when operating the screwdriver 100 in a torque responsive mode (first power transmission mode), while the locator 191 is to be mounted on the sleeve 110*a* when operating the screwdriver 100 in a screw tightening depth responsive mode (second power transmission mode).

First clutch cam 140 is disposed on the end portion of the first spindle 120 which faces the second spindle 130. A first steel ball 143 is located between the first clutch cam 140 and the first spindle 120. The first steel ball 143 is disposed within a recess 120*a* that is formed in the end portion of the first spindle 120. Although it is not particularly shown in FIG. 1, the recess 120*a* extends along the circumferential surface of the first spindle 120 and obliquely with respect to the axial direction (or circumferential direction) of the first spindle 120. The first steel ball 143 can be moved within the recess 120*a* on the first spindle 120 between a first end near to the second spindle 130 and a second end remote from the second spindle 130. The first clutch cam 140 is allowed to move relative to the first spindle 120 in the axial direction of the first spindle 120 by means of the steel ball 143. Further, the first clutch cam 140 is allowed to rotate relative to the first spindle 120 as long as the steel ball 143 is allowed to move between the two ends of the recess 120*a*. On the other hand, when the steel ball 143 is located in the first end of the recess 120*a*, the steel ball 143 is retained in abutment against the wall of the first end of the recess 120*a*. As a result, the first clutch cam 140 is restricted so as to rotate together with the first spindle 120. Further, clutch teeth 141 are provided on the end (right end as viewed in FIG. 1) of the first clutch cam 140 which faces the second spindle 130.

Figure 2:
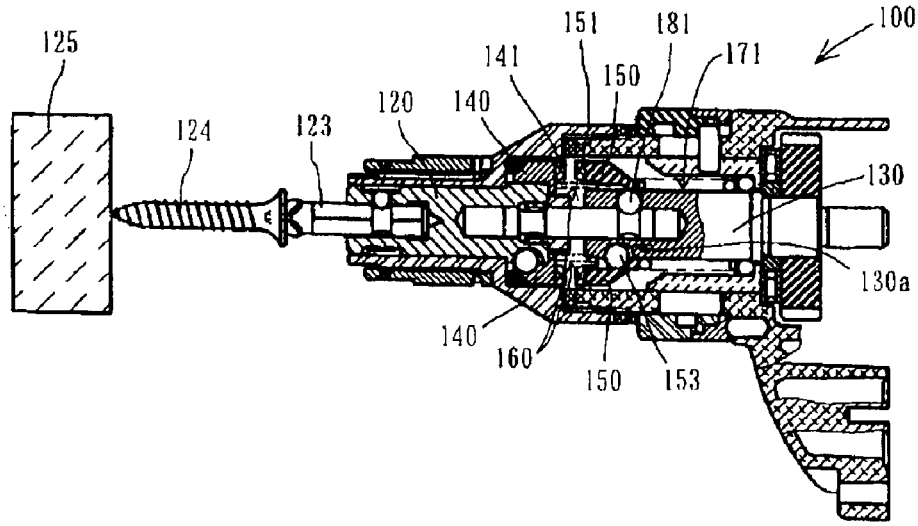
FIG. 2 shows an initial state of the screw-tightening operation according to the representative embodiment in a torque responsive mode.

In screw tightening operation, user of the screwdriver 100 applies a load on the screwdriver 100 while pressing a screw 124 attached to the end of the tool bit 123 against the work-piece 125 (see FIG. 2). At this time, the first clutch cam 140 moves toward the second spindle 130 (to the right as shown in the drawing) together with the first spindle 120 by receiving the reaction force from the work-piece 125 against the pushing force. The operation of the first clutch cam 140 will be described below in further detail.

Second clutch cam 150 is disposed on the end (the left end as shown in FIG. 1) of the second spindle 130 that faces the first spindle 120. A second steel ball 153 is disposed between the second clutch cam 150 and the second spindle 130 within a recess 130*a* formed in the end portion of the second spindle 130. Clutch teeth 151 are provided on the end (left end in FIG. 1) of the second clutch cam 150 that faces the first spindle 120. The second steel ball 153 can be moved in the recess 130*a* on the second spindle 130 between a first end near to the first spindle 120 and a second end remote from the first spindle 120, thereby serving as a positioning member for the second clutch cam 150. The second steel ball 153 allows the second clutch cam 150 to move smoothly in the axial direction of the second spindle 130 and to rotate together with the second spindle 130. The second steel ball 153 that moves in the axial direction between the ends of the recess 130*a* is not necessarily required in order for the second clutch cam 150 to move in the axial direction of the second spindle 130. However, the screwdriver according to this embodiment is constructed to have this feature in order to ensure smooth sliding movement of the second clutch cam 150 with respect to the second spindle 130.

Clutch engagement preventing spring 160 is disposed between the first clutch cam 140 and the second clutch cam 150. The clutch engagement preventing spring 160 provides a biasing force that urges the first clutch cam 140 and the second clutch cam 150 away from each other. In other words, the clutch engagement preventing spring 160 serves to disengage the clutch teeth 141 of the first clutch cam 140 from the clutch teeth 151 of the second clutch cam 150 by the biasing force. Further, the spring 160 serves to keep the clutch teeth 141 and 151 away from each other so as to prevent the clutch teeth 141 and 151 from inadvertently contacting with each other after disengagement.

The structure of the position control mechanism 170 for the second clutch cam will now be described in detail.

Second clutch cam position control mechanism 170 includes a biasing spring 171, stopper 181, stopper operation pin 183, stopper engagement groove 185, ring spring 187 and stopper operation spring 189.

Biasing spring 171 is disposed between the second clutch cam 150 and a biasing spring support washer 179. The biasing spring 171 urges the second clutch cam 150 toward the first clutch cam 140. The biasing spring 171 is a feature that corresponds to the "first position control member" in the first power transmission mode and to the "second-clutch backward movement preventing member" in the second power transmission mode. The biasing spring 171 functions as the both members.

Stopper 181 includes a steel ball. A stopper operation pin 183 is mounted to the first spindle 120. A ring spring 187 is disposed between the stopper operation pin 183 and the first spindle 120. A stopper operation spring 189 urges (biases) the stopper operation pin 183 toward the second spindle 130. A stopper engaging groove 185 is formed in the stopper operation pin 183 and receives the stopper 181.

The stopper engaging groove 185 has a curved or tapered surface which contacts the stopper 181. When the stopper operation pin 183 moves axially by the biasing force of the stopper operation spring 189, the stopper 181 retractably protrudes from the circumferential surface of the second spindle 130. In the state as shown in FIG. 1, however, a leg portion of the second clutch cam 150 is located on the stopper 181. Therefore, the leg portion of the second clutch cam 150 blocks the stopper 181 such that the stopper 181 is not allowed to protrude from the circumferential surface of the second spindle 130. The stopper 181, stopper operation pin 183, stopper engagement groove 185, ring spring 187, and stopper operation spring 189 form a feature that corresponds to the "second position control mechanism" in the first power transmission mode according to the present teachings.

The biasing force of the biasing spring 171 that is exerted on the second clutch cam 150 may be adjusted by co-operation of a torque adjusting ring 173, torque adjusting pin 175, torque adjusting sleeve 177 and biasing spring support washer 179. Specifically, the torque adjusting ring 173 is rotated on the axis of the body 110 so as to slightly move relative to and in the axial direction of the body 110. The torque adjusting ring 173 is connected to the torque adjusting sleeve 177 via the torque adjusting pin 175. Thus, the torque adjusting sleeve 177 moves together with the torque adjusting ring 173 relative to and in the axial direction of the body 110.

Biasing spring support washer 179 is mounted in the end portion of the torque adjusting sleeve 177. The position of the biasing spring support washer 179 on the second spindle 130 can be changed in the axial direction of the second spindle 130. Thus, the length of the biasing spring 171 disposed between the biasing spring support washer 179 and the second clutch cam 150 can be suitably changed to change the biasing force of the biasing spring 171. In this embodiment, the torque in the torque responsive mode, which will be described below in detail, can be adjusted by adjusting the biasing force of the biasing spring 171. Further, in this embodiment, the switching between the torque responsive mode and the screw-tightening depth responsive mode can be achieved by utilizing the movement of the torque adjusting sleeve 177.

The operation and usage of the screwdriver 100 according to the representative embodiment will now be explained. The screwdriver 100 can be selectively used in two modes, the torque responsive mode and the screw-tightening depth responsive mode. In the torque responsive mode, torque transmission from the motor 113 to the tool bit 123 stops when the reaction torque of the screw (screw-tightening torque) reaches a predetermined torque. While, in the screw-tightening depth responsive mode, torque transmission from the motor 113 to the tool bit 123 stops in response to the depth of tightening the screw to the work-piece. The torque responsive mode and the screw-tightening depth responsive mode are features that correspond to the "first power transmission mode" and to the "second power transmission mode" according to the present teachings, respectively.

(Torque Responsive Mode)

The torque responsive mode (first power transmission mode) will now be described. FIGS. 2 to 7 show an essential part of the screwdriver 100 which mainly includes the first spindle 120, second spindle 130, first clutch cam 140, second clutch cam 150, clutch engagement preventing spring 160, and position control mechanism 170 for the second clutch cam. FIG. 2 shows an initial state in which the operation of tightening the screw 124 is about to be started on the work-piece 125 by using the screwdriver 100. In the drawings, only the essential part of the screwdriver 100 is shown for the convenience of illustration, and the components such as the torque adjusting sleeve 177 are shown located in the initial state for convenience sake. It is to be noted that the locator 191 shown in FIG. 1 is not used and removed from the sleeve 110*a* in the torque responsive mode.

In the state as shown in FIG. 2, the second spindle 130 rotates idly without transmitting the rotating torque of the motor 113 (see FIG. 1) to the first spindle 120 and the clutch cam 140. At the same time, the second clutch cam 150 also rotates idly. The second spindle 130 rotates clockwise as viewed from the side of the motor 113. In the state as shown in FIG. 2, the clutch teeth 141 of the first clutch cam 140 and the clutch teeth 151 of the second clutch cam 150 are kept away from each other by the biasing force of the clutch engagement preventing spring 160.

In the state as shown in FIG. 2, the second clutch cam 150 is urged (biased) toward the first clutch cam 140 by the biasing force of the biasing spring 171. The user of the screwdriver 100, however, has not yet applied a load for tightening a screw on the screwdriver 100. As a result, the first spindle 120 and the first clutch cam 140 does not move toward the second clutch cam 150, so that the clutch teeth 140 and 150 are not engaged with each other and kept away from each other.

Further, at this stage, because the second clutch cam 150 is urged toward the first clutch cam 140 by the biasing spring 171, the second steel ball 153 is held within the end portion of the recess 130*a* which is near to the first clutch cam 140, so that the position of the second clutch cam 150 is decided. Specifically, in the state as shown in FIG. 2, the second steel ball 153 is located within the end portion of the recess 130*a* which is near to the first spindle 120 (and near to the first clutch cam 140). Thus, the relative position of the second clutch cam 150 with respect to the second spindle 130 is decided to face the first clutch cam 140. Such position in which the second clutch cam 150 is held near to the first clutch cam 140 is a feature that corresponds to the "torque transmission permitted position" according to the present teachings.

Further, in the state as shown in FIG. 2, the leg portion of the second clutch cam 150 is located on the stopper 181. Therefore, the leg portion of the second clutch cam 150 holds down the stopper 181, thereby preventing the stopper 181 from protruding out of the circumferential surface of the second spindle 130.

When starting the screw-tightening operation from the initial state as shown in FIG. 2, the user presses the screwdriver 100 toward the work-piece 125 (leftward as viewed in the drawing) in order to drive the screw 124 into the work-piece 125. When the user applies a pressing load on the screwdriver 100, the first spindle 120 and the first clutch cam 140 are pressed together with the tool bit 123 toward the second spindle 130 (rightward as shown in the drawing) by receiving the reaction force against the pressing load from the work-piece 125, and thus come to move toward the body 100. This state is shown in FIG. 3.

Figure 3:
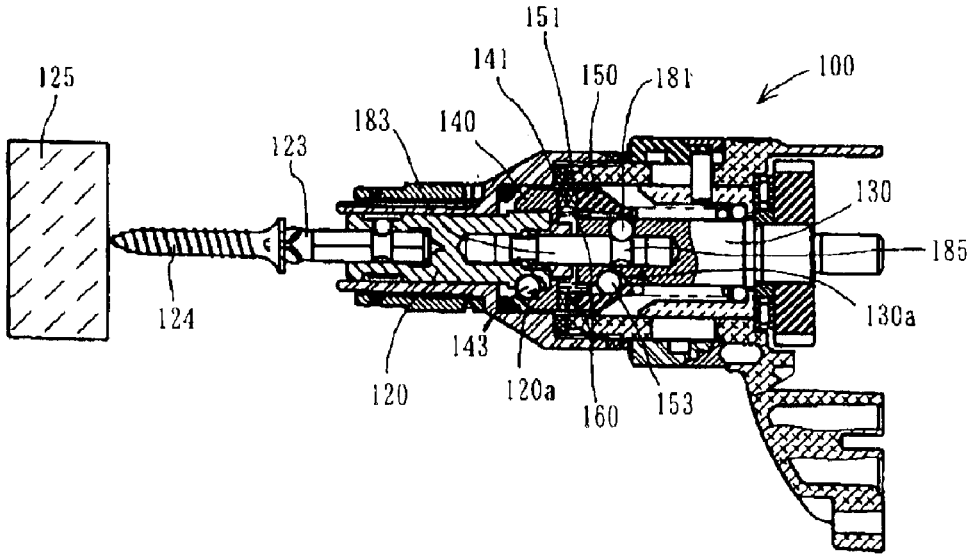
FIG. 3 shows a state in which the first spindle starts to move toward the second spindle when the user of the screw-driver applies a pressing load for tightening the screw.

In the state as shown in FIG. 3, the tool bit 123, the first spindle 120 and the first clutch cam 140 together move rightward by the reaction force against the pressing load. Thus, the clutch teeth 141 of the first clutch cam 140 moves toward the clutch teeth 151 of the second clutch cam 150 opposing the biasing force of the clutch engagement preventing spring 160. At this time, the second clutch cam 150 is urged by the biasing force of the spring 171. Thus, the steel ball 153 is located within the end portion of the recess 130*a* which is near to the first spindle 120. The second clutch cam 150 is located in a position near to the first clutch cam 140, i.e. in a torque transmission permitted position. Thus, the relative distance between the first clutch cam 140 and the second clutch cam 150 gets shorter with the movement of the first clutch cam 140 to the right as shown in the drawing.

Further, in the state as shown in FIG. 3, because the leg portion of the second clutch cam 150 brocks the stopper 181 to protrude outward, the stopper engagement groove 185 abuts against the stopper 181 and thus prevent the stopper operation pin 183 from moving toward the second spindle 130 (rightward as viewed in the drawing) when the first spindle 120 moves rightward. Therefore, when the first spindle 120 moves rightward by the reaction force against the pressing load and the stopper operation pin 183 is prevented from moving toward the second spindle 130, the stopper operation spring 189 disposed between the first spindle 120 and the stopper operation pin 183 is contracted.

Figure 4:
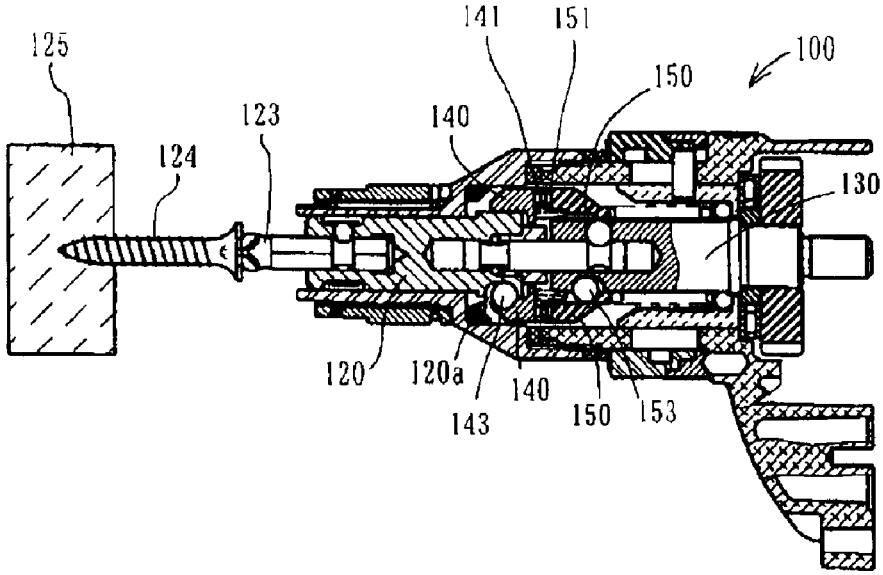
FIG. 4 shows a state in which the clutch teeth of the first clutch cam and the clutch teeth of the second clutch cam start to engage with each other when the first spindle further moves toward the second spindle.

When the first spindle 120 and the first clutch cam 140 further move from the state shown in FIG. 3 toward the second clutch cam 150 (rightward as shown in the drawing), the clutch teeth 141 of the first clutch cam 140 and the clutch teeth 151 of the second clutch cam 150 engage with each other as shown in FIG. 4.

The first steel ball 143 can be moved within the recess 120*a* between one end near to the second spindle 130 and the other end remote from the second spindle 130. As it can be understood in comparison between FIGS. 3 and 4, when the clutch teeth 151 of the second clutch cam 150 that rotates together with the second spindle 130 engages the clutch teeth 141 of the first clutch cam 140, the rotating torque is transmitted to the first clutch cam 140. As a result, the first clutch cam 140 moves axially toward the second clutch cam 150 while rotating relative to the first spindle 120, within the range of movement of the first steel ball 143 between the both ends of the recess 120*a*. Thus, the first steel ball 143 reaches the end of the recess 120*a* which is near to the second spindle 130. In this state, the first clutch cam 140 is allowed to rotate only together with the first spindle 120.

Figure 5:
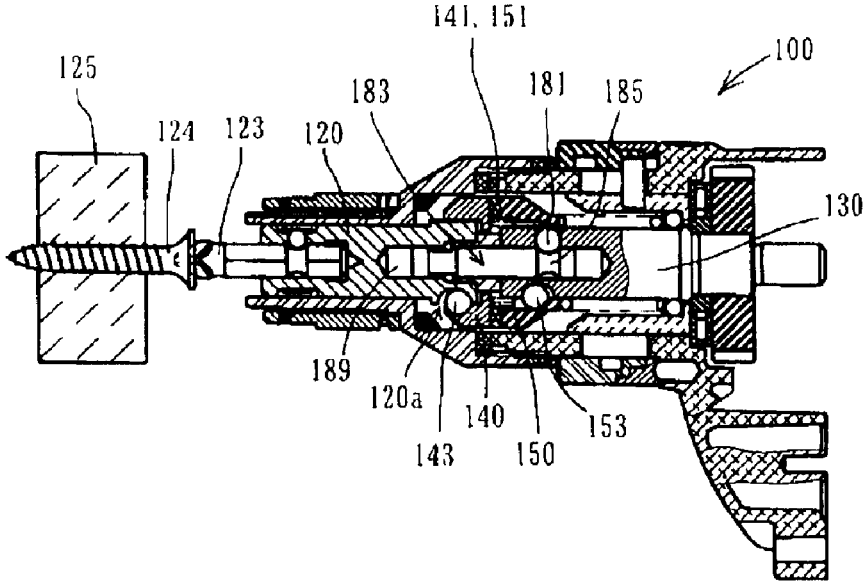
FIG. 5 shows a state in which the both clutch teeth engage with each other.

In the state as shown in FIG. 4, the clutch teeth 141 of the first clutch cam 140 and the clutch teeth 151 of the second clutch cam 150 has started to engage with each other. Then, as it is shown in FIG. 5, the first clutch cam 140 moves on the first spindle 120 by the distance corresponding to the axial length of the recess 120*a* toward the second clutch cam 150. Thus, the clutch teeth 141 of the first clutch cam 140 and the clutch teeth 151 of the second clutch cam 150 completely engage with each other and the screw 124 is driven into the work-piece 125. The position of the second clutch cam 150 as shown in FIGS. 4 and 5 is a feature that corresponds to the "torque transmission permitted position" in the present invention.

According to the representative embodiment, engagement between the both clutch teeth 141 and 151 ensures transmission of the rotating torque of the motor 113 (see FIG. 1). When the both clutch teeth 141 and 151 engage with each other, the rotating torque of the motor 113 is transmitted up to the screw 124 via the second spindle 130, second steel ball 153, second clutch cam 150, clutch teeth 151 of the second clutch cam 150, clutch teeth 141 of the first clutch cam 140, first clutch cam 140, first steel ball 143, first spindle 120, tool bit mounting chuck 121 and tool bit 123.

In the state as shown in FIG. 5, the first spindle 1 moves rightward by receiving the reaction force against the pressing load that the user applies on the screwdriver 100. The stopper 181 is engaged in the stopper engagement groove 185 and thus prevents the stopper operation pin 183 from moving. Therefore, the stopper operation spring 189 disposed between the first spindle 1 and the stopper operation pin 183 is further constricted from the state as shown in FIG. 4.

Figure 6:
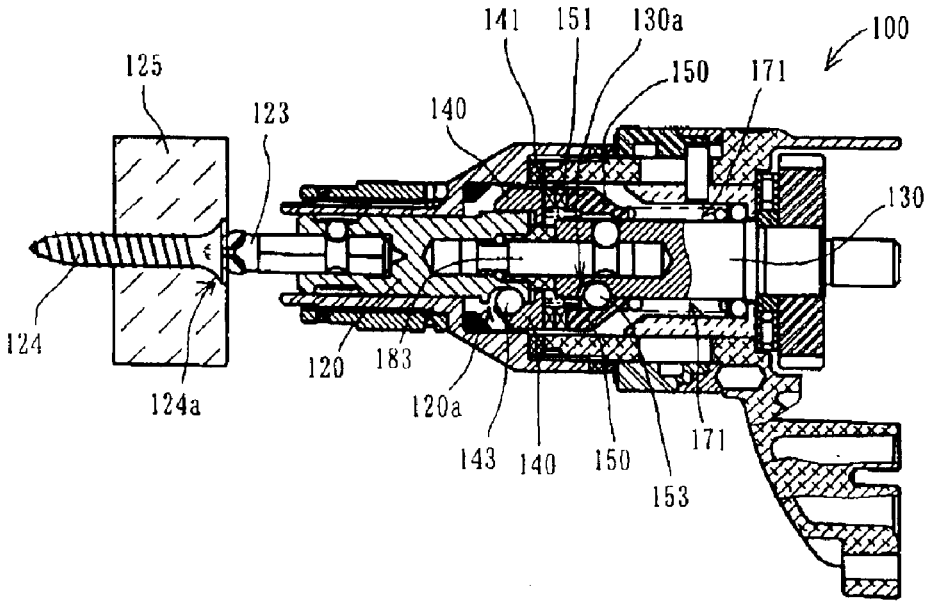
FIG. 6 shows a state in which the screw-tightening operation reaches a final stage.

In the state as shown in FIG. 5, the operation of tightening the screw 124 on the work-piece 125 is proceeding. As it is shown in FIG. 6, when the head seat surface 124*a* of the screw 124 is seated on the work-piece 125, the operation of tightening the screw 124 reaches a final stage. At this time, while the tightening torque increases excessively, the clutch teeth 151 of the second clutch cam 150 further transmits the rotating torque of the motor 113 (see FIG. 1) and thus come to ride on the clutch teeth 141 of the first clutch cam 140. As a result, as it is shown in FIG. 6, the second clutch cam 150 starts to move from the torque transmission permitted position and away from the first clutch cam 140 (rightward as viewed in the drawing) opposing the biasing force of the biasing spring 171.

In the state as shown in FIG. 6, the second steel ball 153 moves within the recess 130*a* away from the end of the recess 130*a* which is near to the first spindle 120 (the first clutch cam 140) so as to assist the second clutch cam 150 to move smoothly.

When the second clutch cam 150 starts to move rightward from the torque transmission permitted position, the leg portion of the second clutch cam 150, which has been located on the stopper 181, also moves rightward. Further, the stopper operation pin 183 is pressed rightward by the biasing force of the contracted stopper operation spring 189. Therefore, as shown in FIG. 7, when the stopper operation pin 183 moves rightward, the stopper engagement groove 185 pushes out the stopper 181 with its curved contact surface, so that the stopper 181 protrudes from the circumferential surface of the second spindle 130.

Figure 7:
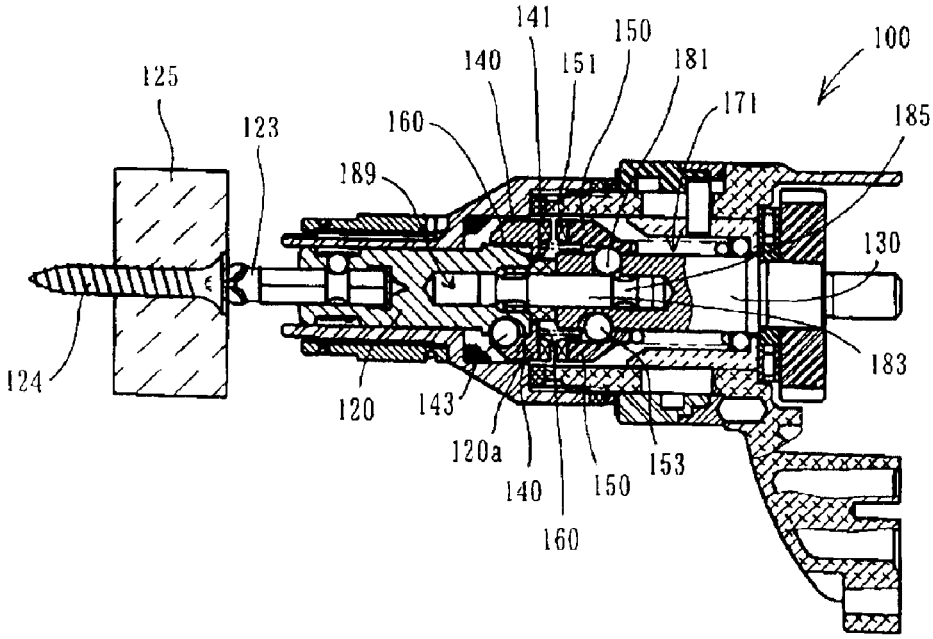
FIG. 7 shows a state in which the first clutch cam is disengaged from the second clutch cam.

As it is shown in FIG. 7, the clutch teeth 141 of the first clutch cam 140 is disengaged from the clutch teeth 151 of the second clutch cam 150. In FIG. 7, the reaction force against the pressing load of the user is applied on the first spindle 120 and thus, the first spindle 120 is held in the nearest position to the second spindle 130. In this state, the first steel ball 143 moves within the recess 120*a* to the end of the recess 120*a* which is remote from the second clutch cam 150. While the first clutch cam 140 moves on the first spindle 120 by the distance corresponding to the axial length of the recess 120*a* away from the second clutch cam 150. Thus, the clutch teeth 141 of the first clutch cam 140 is disengaged from the clutch teeth 151 of the second clutch cam 150.

The first steel ball 143 can be moved within the recess 120*a* of the first spindle 120 between one end near to the second spindle 130 and the other end remote from the second spindle 130. The axial distance between the ends of the recess 120*a* defines the axial distance that the first clutch cam 140 moves during disengagement between the clutch teeth 141 and 151. Further, the axial distance between the ends of the recess 120*a* also defines the amount of clearance between the first clutch cam 140 and the second clutch cam 150 upon disengagement between the clutch teeth 141 and 151.

When the first steel ball 143 moves within the recess 120*a* and abuts the end portion of the recess 120*a* which is remote from the second clutch cam 150, the first clutch cam 140 has moved away from the second clutch cam 150 and is prevented from further movement. The second clutch cam 150 promptly moves away from the first clutch cam 140 by the biasing force of the clutch engagement preventing spring 160 that acts on the first clutch cam 140 and the second clutch cam 150. The disengagement between the clutch teeth 141 and 151 can be maintained.

When the second clutch cam 150 moves rightward as viewed in the drawing, the stopper 181 is freed from restraint of the leg portion of the second clutch cam 150 and thus protrudes outward. As a result, the stopper operation pin 183 moves rightward as viewed in the drawing by the biasing force of the stopper operation spring 189. At this time, the stopper 181 moves into the inner recessed portion of the second clutch cam 150.

In this state, although the biasing force of the biasing spring 171 is exerted on the second clutch cam 150, the stopper 181 protrudes from the circumferential surface of the second spindle 130 and prevents the second clutch cam 150 from moving toward the first clutch cam 140. In other words, when the clutch teeth 151 is disengaged from the clutch teeth 141 due to excessively increased tightening torque of the screw 124, the second clutch cam 150 moves away from the first clutch cam 140 by the biasing force of the clutch engagement preventing spring 160. Then, the stopper 181 engages and holds the second clutch cam 150 in the torque transmission prevented position. Even if a pressing load is applied inadvertently, which causes the first clutch cam 140 to move nearer to the second clutch cam 150 together with the first spindle 120, the stopper 181 engages the second clutch cam 150 in the torque transmission prevented position and prevents the second clutch cam 150 from returning to the torque transmission permitted position. Therefore, unintentional engagement between the clutch teeth 141 and 151 can be avoided. It is to be noted that the stopper 181 allows the second clutch cam 150 to move away from the first clutch cam 140 (rightward as shown in the drawing).

Upon completion of the operation of tightening the screw 124, the user reduces the pressing load on the screwdriver 100. As a result, the first spindle 120 moves away from the second spindle 130 and returns to the initial state as shown in FIG. 2, together with the first clutch cam 140. In the representative embodiment, the first spindle 120 is allowed to return to the initial state when the pressing load decreases below the biasing force of the clutch engagement preventing spring 160. Further, the stopper operation pin 183 that is mounted to the first spindle 120 via the ring spring 187 (see FIG. 1) also returns to the initial state. When the stopper operation pin 183 moves toward the bit end (or the work-piece 125) together with the first spindle 120 and returns to the initial state, the stopper engagement groove 185 moves to under the stopper 181. Then, the stopper 181 is carried from on the circumferential surface of the second spindle 130 into the stopper engagement recess 185, while being pushed with the leg portion of the second clutch cam 150. Thus, the stopper 181 also returns to the initial state as shown in FIG. 2.

When the stopper 181 returns to the initial state, the second clutch cam 150 is allowed to move on the circumferential surface of the second spindle 130 without being engaged with the stopper 181. The second clutch cam 150 moves toward the first clutch cam 140 by the biasing force of the spring 171, which force is larger than the biasing force of the clutch engagement preventing spring 160. At this time, the second steel ball 153 moves within the recess 130*a* to the end portion of the recess 130*a* which is near to the first spindle 120 (the first clutch cam 140), thereby allowing the movement of the second clutch cam 150. Further, the second steel ball 153 abuts against this end portion of the recess 130*a,* thereby positioning the second clutch cam 150 on the second spindle 130. Thus, the screwdriver 100 is returned to the initial state (see FIG. 2) in which the first clutch cam 140 and the second clutch cam 150 are apart from each other.

As it is described above, in the screwdriver 100 in the torque responsive mode, when the tightening torque increases excessively and thus, the reaction torque that the tool bit 123 receives from the side of the work-piece 125 increases up to a predetermined torque, the clutch teeth 151 of the second clutch cam 150 is disengaged and promptly moved away from the clutch teeth 141 of the first clutch cam 140 by the biasing force of the clutch engagement preventing spring 160. At this time, the stopper 181 engages and holds the second clutch cam 150 in the torque transmission prevented position and thus, prevents the second clutch cam 150 from moving toward the torque transmission permitted position.

The stopper engagement groove 185 according to the representative embodiment may have a tapered or curved surface, or various other shapes which permits the stopper 181 to protrude from the circumferential surface of the second spindle 130. Further, although in the above representative embodiment, the clutch engagement preventing spring 160 is disposed between the first clutch cam 140 and the second clutch cam 150, it may be provided separately for each of the clutch cams 140 and 150 and independently exert the biasing force on the associated clutch cam.

(Screw-Tightening Depth Responsive Mode)

Figure 8:
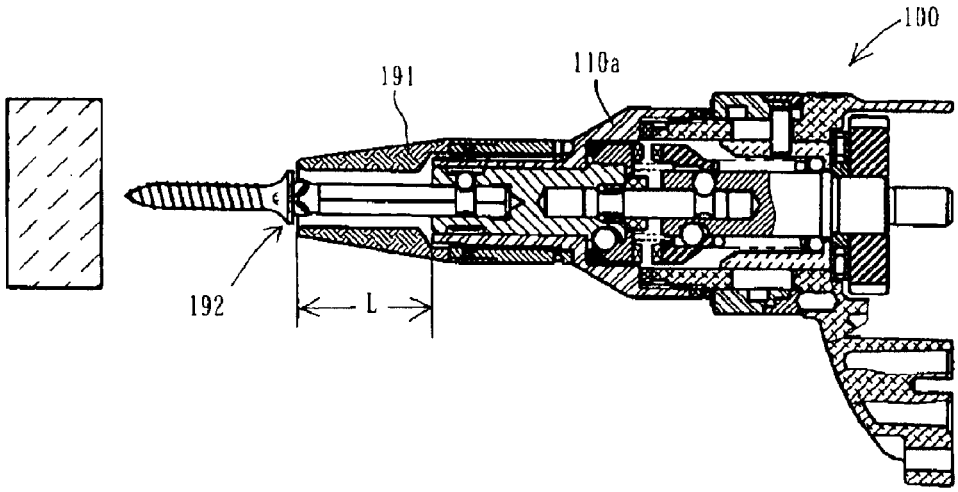
FIG. 8 shows a state in which a locator is mounted on the screwdriver in order to switch the torque responsive mode to the screw-tightening depth responsive mode.

The screw-tightening depth responsive mode (second power transmission mode) of the screwdriver 100 according to the representative embodiment will now be explained with reference to FIGS. 8 to 14. Features which have substantially the same structures as in the torque responsive mode will not be described in detail. In order to switch the screwdriver 100 from the torque responsive mode to the screw-tightening depth responsive mode, as it is shown in FIG. 8, the locator 191 is attached to the sleeve 110*a*. The locator 191 attached to the sleeve 110*a* has an effective length "L" extending from the end of the sleeve 110*a* (or the end of the body 110) to the end portion 192 of the locator 191.

Figure 9:
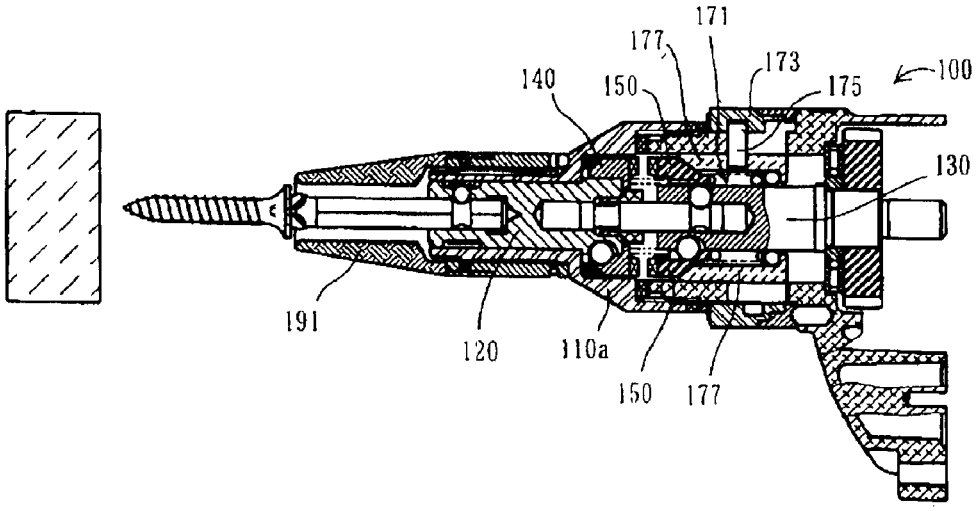
FIG. 9 shows an initial state of the screwdriver in the screw-tightening depth responsive mode.

Then, as it is shown in FIG. 9, a torque adjusting ring 173 is operated so as to move the torque adjusting sleeve 177, via the torque adjusting pin 175, into contact with the second clutch cam 150 which is located in the torque transmission permitted position. As a result, the second clutch cam 150 is prevented from moving from the torque transmission permitted position back to the torque transmission prevented position. In other words, the torque adjusting sleeve 177 prevents the second clutch cam 150 in the torque transmission permitted position from moving on the second spindle 130 away from the first spindle 120 and the first clutch cam 140.

Although in the above-described torque responsive mode, the torque adjusting sleeve 177 is used to adjust the torque for clutch disengagement by changing the biasing force of the biasing spring 171, in the screw-tightening depth responsive mode, it is used to prevent the second clutch cam 150 from moving backward. The torque adjusting sleeve 177 is a feature that corresponds to the "second-clutch backward movement preventing member" according to the present invention. Therefore, the torque adjusting sleeve 177 is a feature that corresponds to the "second position control mechanism" for the second clutch cam 150 in the torque responsive mode, and to the "second-clutch backward movement preventing member" for the second clutch cam 150 in the screw-tightening depth responsive mode. Thus, the torque adjusting sleeve 177 has the both functions. In the screw-tightening depth responsive mode, the biasing force of the biasing spring 171 does not affect the engagement and disengagement of the clutch.

Figure 10:
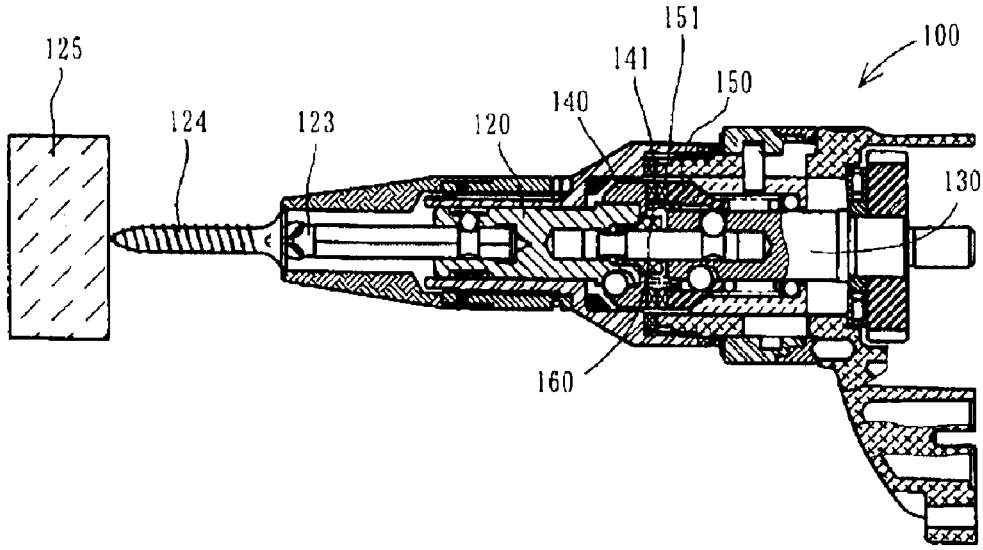
FIG. 10 shows a state in which the first spindle starts to move toward the second spindle when the user of the screw-driver applies pressing load for tightening the screw.

Preparation for switching to the screw-tightening depth responsive mode will be completed when the locator 191 is attached to the sleeve 110*a* and the torque adjusting sleeve 177 contacts the second clutch cam 150. When the screw-tightening operation is started from the initial state of the screw-tightening depth responsive mode which is shown in FIG. 9, the user presses the screwdriver 100 toward the work-piece 125 (leftward in the drawing) as shown in FIG. 10 in order to drive the screw 124 into the work-piece 125. When the user applies a pressing load onto the screwdriver 100, the first spindle 120 and the first clutch cam 140 are pressed together with the tool bit 123 toward the second spindle 130 (rightward as shown in the drawing) by receiving the reaction force against the pressing load from the side of the work-piece 125, and thus move toward the body 100. FIG. 10 shows the state just before the engagement between the clutch teeth 141 of the first clutch cam 140 and the clutch teeth 151 of the second clutch cam 150.

Figure 11:
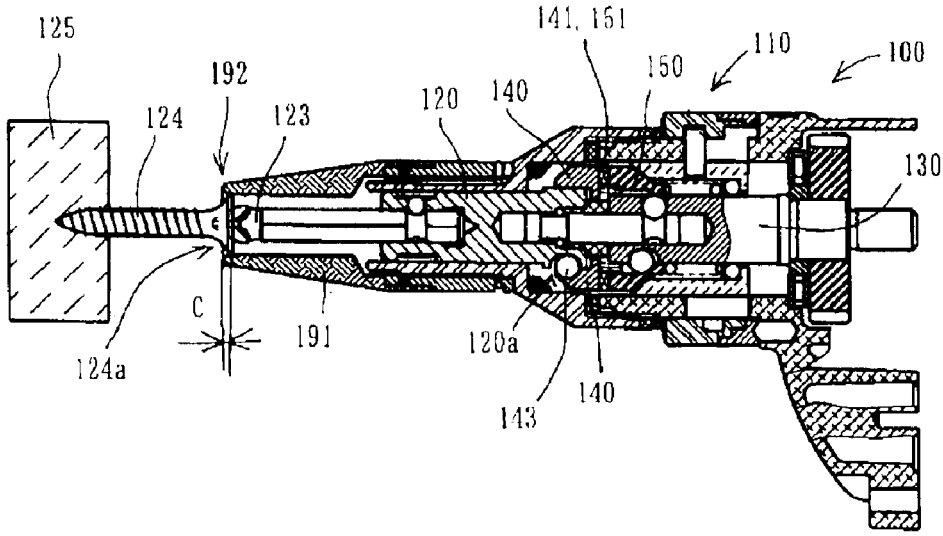
FIG. 11 shows a state in which the both clutch teeth with engage each other.

When the screwdriver 100 is further pressed toward the work-piece 125 from the state as shown in FIG. 10, the clutch teeth 141 of the first clutch cam 140 and the clutch teeth 151 of the second clutch cam 150 engage with each other. Then, as shown in FIG. 11, the first clutch cam 140 moves toward the second clutch cam 150 by the distance corresponding to the axial length of the recess 120*a,* while the first steel ball 143 moves to the end of the recess 120*a* which is near to the second clutch cam 150. As a result, the clutch teeth 141 of the first clutch cam 140 and the clutch teeth 151 of the second clutch cam 150 completely engage with each other. Thus, the rotating torque of the motor 113 which is shown in FIG. 1 is transmitted up to the screw 124 via the second spindle 130, second clutch cam 150, second clutch teeth 151, first clutch teeth 141, first clutch cam 140, first spindle 120 and tool bit 123. In this state, the screw 124 is driven into the work-piece 125.

In this stage, the end 192 of the locator 191 is not yet in contact with the work-piece 125. Further, the tool bit 123 slightly moves inward from the locator end 192 toward the body 110 by the pressing load onto the screwdriver 100. As a result, a setback "C" is defined between the locator end 192 and the head seat surface 124*a* of the screw 124 which is seated on the work-piece 125.

Figure 12:
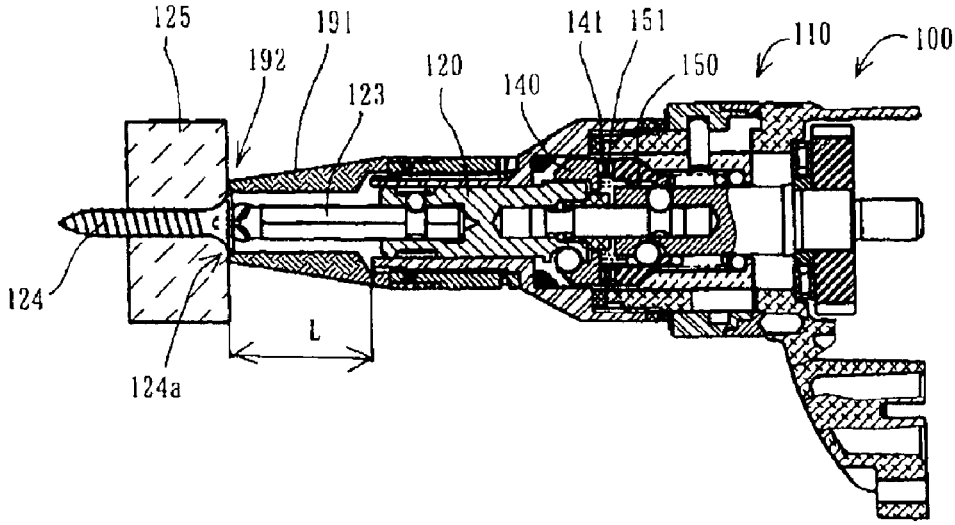
FIG. 12 shows a state in which a locator end is in abutment with the work-piece.

When the screw 124 is driven into the work-piece 125 as shown in FIG. 12, the end 192 of the locator 191 abuts against the work-piece 125, thereby preventing the body 110 from further moving toward the work-piece 125. In other words, the locator 191 prevents the body 110 from approaching within a predetermined distance L of the work-piece 125. In the state as shown in FIG. 12, the screw 124 is further tightened in the state that the locator 191 prevents the body 110 from moving further toward the work-piece 125. As a result, the tool bit 123, the first spindle 120 and the first clutch cam 140 move toward the work-piece 125 by the distance of the setback "C" as shown in FIG. 11 with respect to the second clutch cam 150, the second spindle 130 and other components of the body 110. Then, the head seat surface 124*a* of the screw 124 is seated on the work-piece 125. At this time, because the first clutch cam 140 moves toward the work-piece 125 by the distance of the setback "C" with respect to the second clutch cam 150, the clutch teeth 141 moves away from the clutch teeth 151 by the distance of the setback "C" and is kept in engagement with the clutch teeth 151.

Figure 13:
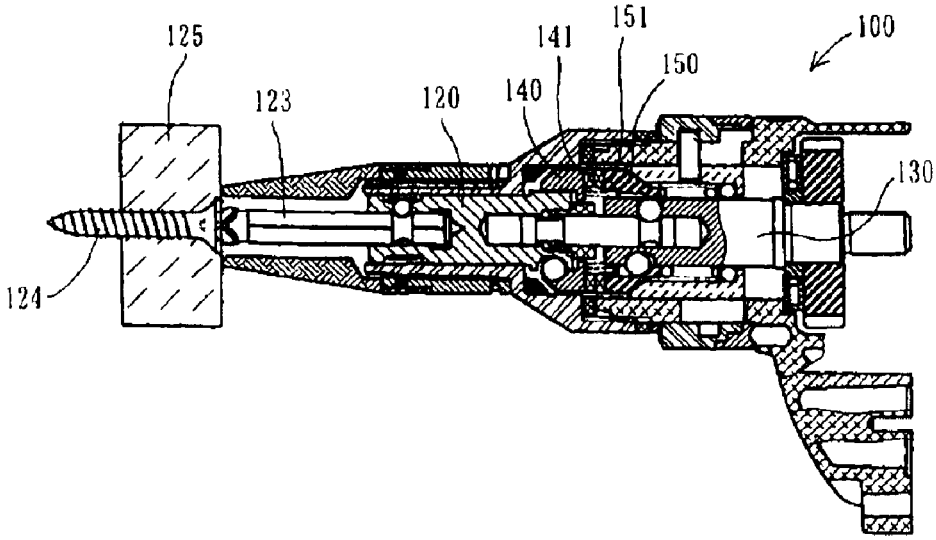
FIG. 13 shows a state in which the screw is further tightened on the work-piece after the locator is seated on the work-piece.

Because the clutch teeth 141 and 151 are kept in engagement with each other, the screw 124 is further tightened on the work-piece 125 with the tool bit 123 in the state that the locator end 192 is in abutment with the work-piece 125 as shown in FIG. 12. According to the representative embodiment, additional tightening of the screw 124 can be thus achieved. As a result, the tool bit 123, the first spindle 120 and the first clutch cam 140 further move toward the work-piece 125 with respect to the second clutch cam 150, the second spindle 130 and other components of the body 110. Then, as shown in FIG. 13, when the screw 124 is tightened to a predetermined depth with respect to the work-piece 125, the first clutch cam 140 moves a predetermined distance away from the second clutch cam 150. This is corresponding to a state just before the disengagement of the clutch teeth 141 and 151.

Figure 14:
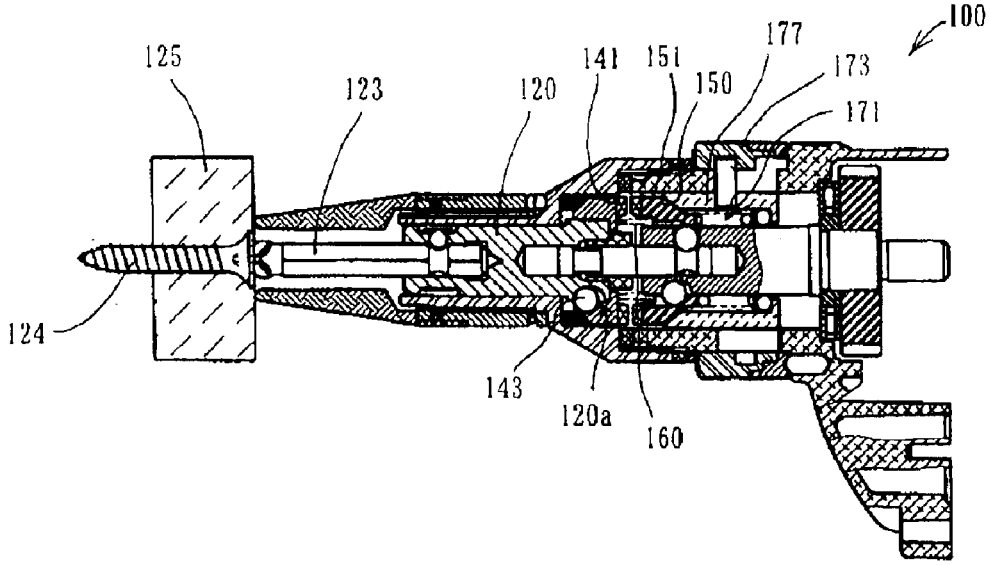
FIG. 14 shows a state in which the first clutch cam is disengaged from the second clutch cam upon completion of the screw-tightening operation.

Then, as shown in FIG. 14, the first clutch cam 140 moves by the distance corresponding to the axial length of the recess 120*a* away from the second clutch cam 150, while the first steel ball 143 moves to the end of the recess 120*a* which is remote from the second clutch cam 150. As a result, the clutch teeth 141 is disengaged from the clutch teeth 151. The clutch teeth 141 and 151 can be promptly and reliably disengaged from each other by the biasing force of the clutch engagement preventing spring 160. As a result, any noise and vibration caused by a contact between the clutch teeth 141 and 151 can be effectively prevented. The effectiveness as a silent clutch can be thus ensured.

Upon the clutch disengagement, torque transmission from the second clutch cam 150 side to the first clutch cam 140 side can be shut off. Then, in the screw-tightening depth responsive mode, the tightening operation of the screw 124 on the work-piece 125 is completed. Thereafter, when the user reduces the pressing load onto the screwdriver 100 below the biasing force of the clutch engagement preventing spring 160, the tool bit 123, the first spindle 120 and the first clutch cam 140 return to the initial state as shown in FIG. 9. In this state, the screwdriver 100 is ready for the subsequent screw-tightening operation.

According to the representative embodiment, the screwdriver 100 is arranged such that the torque adjusting sleeve 177 abuts on the second clutch cam 150 to thereby prevent the second clutch cam 150 from moving backward and to normally hold the second clutch cam 150 in the torque transmission permitted position. Therefore, the screwdriver 100 can be readily switched to the screw-tightening depth responsive mode simply by additionally attaching the locator 191 to the screwdriver 100. The components used in the responsive mode are also used in the tightening depth responsive mode.

Further, in the torque responsive mode, the torque adjusting ring 173 of the representative embodiment is suitably rotated to change the biasing force of the biasing spring 171 so that the torque for clutch disengagement can be varied. In addition, in the screw-tightening depth responsive mode, the torque adjusting sleeve 177 abuts on the second clutch cam 150 to thereby prevent the second clutch cam 150 from moving backward from the torque transmission permitted position. With this structure, the clutch disengagement can be achieved according to the screw-tightening depth. Thus, the present teachings provide a practical screwdriver 100 which can be readily switched between the torque responsive mode and the screw-tightening depth responsive mode with the torque adjusting ring 173.

100 screwdriver
110 body (motor housing)
110*a* sleeve
113 motor
113*a* output shaft
115 speed reducing mechanism
120 first spindle
120*a* recess
121 tool bit mounting chuck
123 tool bit
124 screw
124*a* head seat surface
125 work-piece
130 second spindle
130*a* recess
140 first clutch cam (first clutch member)
141 clutch teeth
143 first steel ball
150 second clutch cam (second clutch member)
151 clutch teeth
153 second steel ball
160 clutch engagement preventing spring (clutch engagement preventing member)
170 position control mechanism for the second clutch cam
171 biasing spring
173 torque adjusting ring
175 torque adjusting pin
177 torque adjusting sleeve
179 biasing spring support washer
181 stopper
183 stopper operation pin
185 stopper engagement groove
187 ring spring
189 stopper operation spring

What we claim is:

1. A screwdriver, comprising:

a motor, a body that houses the motor, a first spindle that can rotate and move relative to the body, a first clutch member disposed on one end portion of the first spindle, wherein the first clutch member rotates together with the first spindle while being allowed to move relative to the first spindle in the axial direction of the first spindle, a tool bit connected to the other end portion of the first spindle to perform a screw tightening operation, a second spindle connected to the motor to receive the rotating torque of the motor, a second clutch member that rotates together with the second spindle while being allowed to move relative to the second spindle in the axial direction of the second spindle, wherein the second clutch member is engaged with the first clutch member when the first spindle moves toward the body to transmit the rotating torque of the motor to the tool bit, a clutch engagement preventing member that urges the first clutch member and the second clutch member away from each other, the screwdriver being selectively operated in one of a first power transmission mode and a second power transmission mode, wherein in the first power transmission mode, the first clutch member and the second clutch member engage with each other to transmit the rotating torque of the motor to the tool bit, while the first and second clutch members are disengaged from each other when the reaction torque applied from the work-piece onto the tool bit exceeds a predetermined torque, and in the second power transmission mode, the first clutch member and the second clutch member engage with each other to transmit the rotating torque of the motor to the tool bit, while the clutch members are disengaged from each other when the tool bit moves a predetermined distance away from the body toward the work-piece during the screw-tightening operation.

2. The screwdriver as defined in claim 1, further comprising a position control mechanism for the second clutch member during the operation in the first power transmission mode, the position control mechanism including a first position control mechanism and a second position control mechanism, the first position control mechanism being arranged to hold the second clutch member in a torque transmission permitted position close to the first clutch member when the reaction torque applied from the work-piece onto the tool bit is within a predetermined range and the second position control mechanism being arranged to prevent the second clutch member from moving to the torque transmission permitted position when the reaction torque exceeds the predetermined range and the second clutch member moves by means of the clutch engagement preventing member from the torque transmission permitted position to a torque transmission prevented position distant from the first clutch member with respect to the torque transmission permitted position.

3. The screwdriver as defined in claim 1, further comprising a second-clutch backward movement preventing member for preventing the second clutch member in the second power transmission mode from moving backward away from the first clutch member in the axial direction of the second spindle.

4. The screwdriver as defined in claim 1, further comprising a second-clutch backward movement preventing member that prevents the second clutch member in the second power transmission mode from moving backward away from the first clutch member in the axial direction of the second spindle, the second-clutch backward movement preventing member also serving as the first position control member in the first power transmission mode.

5. The screwdriver as defined in claim 1, further comprising a body position defining member that prevents the body in the second power transmission mode from closing to the work-piece within a predetermined distance, wherein the screw-tightening operation is performed in the second power transmission mode such that the body approach preventing member prevents the body from approaching within the predetermined distance of the work-piece, the first spindle moves relative to the body toward the work-piece together with the first clutch member and the first clutch member is disengaged from the second clutch member.

6. The screwdriver as defined in claim 1, wherein the first clutch member and the second clutch member respectively include clutch teeth so as to face with each other.

7. A screwdriver, comprising:

1 a motor, a body that houses the motor, a first spindle that can rotate and move relative to the body, a first clutch member disposed on one end portion of the first spindle, wherein the first clutch member rotates together with the first spindle while being allowed to move relative to the first spindle in the axial direction of the first spindle, a tool bit connected to the other end portion of the first spindle to perform a screw tightening operation, a second spindle connected to the motor to receive the rotating torque of the motor, a second clutch member that rotates together with the second spindle while being allowed to move relative to the second spindle in the axial direction of the second spindle, wherein the second clutch member is engaged with the first clutch member when the first spindle moves toward the body to transmit the rotating torque of the motor to the tool bit, a clutch engagement preventing member that urges the first clutch member and the second clutch member away from each other, wherein the second clutch member is located in a torque transmission permitted position to transmit the rotating torque of the motor to the tool bit when the reaction torque applied from the work-piece onto the tool bit is within a predetermined range, while the second clutch member is located in a torque transmission prevented position by means of the clutch engagement preventing member and is prevented from moving to the torque transmission permitted position to secure the disengagement of the first and the second clutch members when the reaction torque exceeds a predetermined torque.

8. The screwdriver as defined in claim 7, wherein the first clutch member and the second clutch member include clutch teeth so as to face with each other.

9. The screwdriver as defined in claim 7, further comprising a position control mechanism for the second clutch member, the position control mechanism including a first position control mechanism and a second position control mechanism, the first position control mechanism being arranged to hold the second clutch member in a torque transmission permitted position close to the first clutch member when the reaction torque applied from the work-piece onto the tool bit is within a predetermined range, and the second position control mechanism being arranged to prevent the second clutch member from moving to the torque transmission permitted position when the reaction torque exceeds the predetermined range and when the second clutch member moves by means of the clutch engagement preventing member from the torque transmission permitted position to the torque transmission prevented position.

10. The screwdriver as defined in claim 7, further comprising a stopper that holds the second clutch member in the torque transmission prevented position when the reaction torque exceeds the predetermined range and when the second clutch member moves by means of the clutch engagement preventing member from the torque transmission permitted position to the torque transmission prevented position.

11. The screwdriver as defined in claim 7, further comprising a stopper that protrudes from the circumferential surface of the second spindle to hold the second clutch member in the torque transmission prevented position when the reaction torque exceeds the predetermined range and when the second clutch member moves by means of the clutch engagement preventing member from the torque transmission permitted position to the torque transmission prevented position.

12. The screwdriver as defined in claim 7, further comprising a spring that biases the second clutch member towards the first clutch member.

13. A method of using a screwdriver that includes:

a motor, a body that houses the motor, a first spindle that can rotate and move relative to the body, a first clutch member disposed on one end portion of the first spindle, wherein the first clutch member rotates together with the first spindle while being allowed to move relative to the first spindle in the axial direction of the first spindle, a tool bit connected to the other end portion of the first spindle to perform a screw tightening operation, a second spindle connected to the motor to receive the rotating torque of the motor, a second clutch member that rotates together with the second spindle while being allowed to move relative to the second spindle in the axial direction of the second spindle, wherein the second clutch member is engaged with the first clutch member when the first spindle moves toward the body to transmit the rotating torque of the motor to the tool bit, a clutch engagement preventing member that urges the first clutch member and the second clutch member away from each other, the method comprising a step of selectively operating the screwdriver in one of a first power transmission mode and a second power transmission mode, wherein in the first power transmission mode, the first clutch member and the second clutch member engage with each other to transmit the rotating torque of the motor to the tool bit, while the first and second clutch members are disengaged from each other when the reaction torque applied from the work-piece onto the tool bit exceeds a predetermined torque, and in the second power transmission mode, the first clutch member and the second clutch member engage with each other to transmit the rotating torque of the motor to the tool bit, while the clutch members are disengaged from each other when the tool bit moves a predetermined distance away from the body toward the work-piece during the screw-tightening operation.

14. A method of using a screwdriver that includes:

a motor, a body that houses the motor, a first spindle that can rotate and move relative to the body, a first clutch member disposed on one end portion of the first spindle, wherein the first clutch member rotates together with the first spindle while being allowed to move relative to the first spindle in the axial direction of the first spindle, a tool bit connected to the other end portion of the first spindle to perform a screw tightening operation, a second spindle connected to the motor to receive the rotating torque of the motor, a second clutch member that rotates together with the second spindle while being allowed to move relative to the second spindle in the axial direction of the second spindle, wherein the second clutch member is engaged with the first clutch member when the first spindle moves toward the body to transmit the rotating torque of the motor to the tool bit, a clutch engagement preventing member that urges the first clutch member and the second clutch member away from each other, the method comprising steps of locating the second clutch member in a torque transmission permitted position to transmit the rotating torque of the motor to the tool bit when the reaction torque applied from the work-piece onto the tool bit is within a predetermined range and locating the second clutch member in a torque transmission prevented position by means of the clutch engagement preventing member such that the second clutch member is prevented from moving to the torque transmission permitted position to ensure the disengagement of the first and the second clutch members when the reaction torque exceeds a predetermined torque.

15. A screwdriver comprising:

a motor, a body that houses the motor, a first spindle that can rotate and move relative to the body, a first clutch member disposed on one end portion of the first spindle, wherein the first clutch member rotates together with the first spindle while being allowed to move relative to the first spindle in the axial direction of the first spindle, a tool bit connected to the other end portion of the first spindle to perform a screw tightening operation, a second spindle connected to the motor to receive the rotating torque of the motor, a second clutch member that rotates together with the second spindle while being allowed to move relative to the second spindle in the axial direction of the second spindle, wherein the second clutch member is engaged with the first clutch member when the first spindle moves toward the body to transmit the rotating torque of the motor to the tool bit, means for preventing the engagement of the clutch members by urging the first clutch member and the second clutch member away from each other, the screwdriver being selectively operated in one of a first power transmission mode and a second power transmission mode, wherein in the first power transmission mode, the first clutch member and the second clutch member engage with each other to transmit the rotating torque of the motor to the tool bit, while the first and second clutch members are disengaged from each other when the reaction torque applied from the work-piece onto the tool bit exceeds a predetermined torque, and in the second power transmission mode, the first clutch member and the second clutch member engage with each other to transmit the rotating torque of the motor to the tool bit, while the clutch members are disengaged from each other when the tool bit moves a predetermined distance away from the body toward the work-piece during the screw-tightening operation.

16. The screwdriver as defined in claim 15, further comprising means for controlling the position of the second clutch member during the operation in the first power transmission mode, the position control means including a first position control means and a second position control means, the first position control means being arranged to hold the second clutch member in a torque transmission permitted position close to the first clutch member when the reaction torque applied from the work-piece onto the tool bit is within a predetermined range, and the second position control means being arranged to prevent the second clutch member from moving to the torque transmission permitted position when the reaction torque exceeds the predetermined range and the second clutch member moves by means of the clutch engagement preventing member from the torque transmission permitted position to a torque transmission prevented position distant from the first clutch member with respect to the torque transmission permitted position.

17. The screwdriver as defined in claim 15, further comprising means for preventing the second clutch member in the second power transmission mode from moving backward away from the first clutch member in the axial direction of the second spindle.

18. The screwdriver as defined in claim 15, further comprising means for preventing the second clutch member in the second power transmission mode from moving backward away from the first clutch member in the axial direction of the second spindle, the second-clutch backward movement preventing means also serving as the first position control means in the first power transmission mode.

19. The screwdriver as defined in claim 15, further comprising means for defining the position of the body so as to prevent the body in the second power transmission mode from closing to the work-piece within a predetermined distance, wherein the screw-tightening operation is performed in the second power transmission mode such that the body approach preventing means prevents the body from approaching within the predetermined distance of the work-piece, the first spindle moves relative to the body toward the work-piece together with the first clutch member and the first clutch member is disengaged from the second clutch member.

20. A screwdriver, comprising:

a motor, a body that houses the motor, a first spindle that can rotate and move relative to the body, a first clutch member disposed on one end portion of the first spindle, wherein the first clutch member rotates together with the first spindle while being allowed to move relative to the first spindle in the axial direction of the first spindle, a tool bit connected to the other end portion of the first spindle to perform a screw tightening operation, a second spindle connected to the motor to receive the rotating torque of the motor, a second clutch member that rotates together with the second spindle while being allowed to move relative to the second spindle in the axial direction of the second spindle, wherein the second clutch member is engaged with the first clutch member when the first spindle moves toward the body to transmit the rotating torque of the motor to the tool bit, means for preventing the engagement of the clutch members by urging the first clutch member and the second clutch member away from each other, wherein the second clutch member is located in a torque transmission permitted position to transmit the rotating torque of the motor to the tool bit when the reaction torque applied from the work-piece onto the tool bit is within a predetermined range, while the second clutch member is located in a torque transmission prevented position by means of the clutch engagement preventing means and is prevented from moving to the torque transmission permitted position to secure the disengagement of the first and the second clutch members when the reaction torque exceeds a predetermined torque.

21. The screwdriver as defined in claim 20, further comprising means for controlling the position of the second clutch member, the position control means including a first position control means and a second position control means, the first position control means being arranged to hold the second clutch member in a torque transmission permitted position close to the first clutch member when the reaction torque applied from the work-piece onto the tool bit is within a predetermined range, and the second position control means being arranged to prevent the second clutch member from moving to the torque transmission permitted position when the reaction torque exceeds the predetermined range and when the second clutch member moves by means of the clutch engagement preventing member from the torque transmission permitted position to the torque transmission prevented position.

* * * * *